US005095994A

United States Patent [19]

Dollison

[11] Patent Number: 5,095,994

[45] Date of Patent: Mar. 17, 1992

[54] FLOW ACTUATED SAFETY VALVE WITH RETRIEVABLE CHOKE AND METAL SEALS

[75] Inventor: William W. Dollison, Dallas, Tex.

[73] Assignee: Otis Engineering Corportion, Dallas, Tex.

[21] Appl. No.: 610,708

[22] Filed: Nov. 8, 1990

[51] Int. Cl.[5] ..... E21B 34/08; E21B 34/10

[52] U.S. Cl. ..... 166/386; 166/319; 166/323

[58] Field of Search ..... 166/386, 319, 325, 332, 166/334, 323

[56] References Cited

U.S. PATENT DOCUMENTS

| | | | |
|---|---|---|---|
| 4,721,162 | 1/1988 | Pringle et al. | 166/319 |
| 4,760,879 | 8/1988 | Pringle | 166/123 X |
| 4,890,674 | 1/1990 | Le | 166/319 |

*Primary Examiner*—William P. Neuder

*Attorney, Agent, or Firm*—Roland O. Cox

[57] ABSTRACT

A safety valve for use in a well conduit which is automatically actuated to close when production flow impingement on a retrievable flow choke in the safety valve operating tube is sufficient. The safety valve utilizes all metal to metal seals and includes a unique roller detent mechanism, which releasably positions the operating tube in valve open position and provides snap closure of the valve. The operating tube has internal locking recesses and a metal seat. A flow choke of the size to cause safety valve closure at a selected flow rate is connected on a lock mandrel having a metal sealing surface. The lock mandrel with choke is lowered into the safety valve and operated to seal on the metal seat and lock in the locking recesses. When it is desirable to change the choke size, the lock mandrel is retrieved from the safety valve to surface.

10 Claims, 3 Drawing Sheets

FLOW ACTUATED SAFETY VALVE WITH RETRIEVABLE CHOKE AND METAL SEALS

BACKGROUND

1. Field

This invention pertains to a safety valve useful in well conduits which is actuated to close by production flow impingement on a flow choke in the valve. These safety valves are also known as pressure differential operated or direct acting safety valves.

2. Related Art

A number of U.S. Patents have issued for direct acting safety valves which utilize poppet, ball or flapper valves and include ball type detent mechanisms to hold the valve open until an actuating flow rate through the choke is reached and then permit very quick or "snap" closure of the valve.

An example of a safety valve actuated by flow with ball type snap closure feature utilizing a poppet type valve is shown in U.S. Pat. No. 3,070,119 to Raulins entitled WELL TOOLS. This valve utilizes a "bean" or flow choke which cannot be retrieved from the valve and resilient material 'o' rings for seals.

U.S. Pat. No. 3,126,908 to Dickens for WELL TOOLS discloses a pressure operated valve with ball type snap closure structure which employs a ball type main valve. The valve also has a bean which cannot be retrieved and uses a number of resilient material 'o' rings for sealing.

Another U.S. Pat. No. 4,664,195 for SAFETY VALVE to Deaton shows a direct acting safety valve having a main flapper type valve and using resilient material seal means. Resilient seals rapidly deteriorate and leak in the high temperature and corrosive environment found in deeper wells.

U.S. Pat. No. 4,362,214 to Pringle and Morris disclose a flapper type differential actuated well safety valve having a housing, a valve element, a flow tube, spring means, a choke bean and releasable connecting means for connecting the choke bean to and releasing it from the flow tube by longitudinal movement of the bean relative to the flow tube.

DISCLOSURE OF INVENTION

The present invention is a direct acting safety valve having a flapper valve, all metal to metal seals, and a retrievable flow choke carried on a lock mandrel, which locks and seals in the safety valve operating tube. Production flow impingement force on the flow choke overcomes the force of a roller type snap closure device and a spring holding the operating tube in valve open position, releasing the operating tube to move upward quickly to a position permitting the flapper valve to close. In the upper end of the operating tube of the present invention are shown locking recesses for the rotary lock mandrel and a metal seat engageable by the metal sealing surface on the rotary lock mandrel of copending U.S. Pat. application No. 07/557,668, filed July 25, 1990, for ROTARY LOCKING SYSTEM WITH METAL SEALS, invented by William W. Dollison. A flow choke of a desired size is connected on the rotary lock mandrel, which may be installed to seal metal to metal and lock in the operating tube of the safety valve positioning the flow choke in the production flowing upwardly through the open safety valve. A well flow control device (not shown) may also be connected to the lock mandrel. As previously stated, the locking recesses shown are of the type in which a rotary lock mandrel may be locked. Those skilled in the art should understand any form of recesses in which a lock mandrel could be locked may be used and any type lock mandrel having a metal sealing surface and in which a flow choke can be installed could be used in carrying out this invention.

When it is desired to change the flow choke size, the lock mandrel is unlocked from the safety valve operating tube and retrieved to surface where the new size flow choke is attached to the lock mandrel. The lock mandrel may be lowered down the well conduit and reinstalled in the safety valve operating tube.

An object of this invention is to provide a safety valve useful in a well conduit which is actuated to close by production flow impingement on a retrievable flow choke in the operating tube.

An object of this invention is to provide a safety valve utilizing metal seals throughout.

Another object of this invention is to provide a safety valve wherein the flow choke is carried by a lock mandrel which after locking in the safety valve operating tube may be released and retrieved to surface for changing choke size.

Also an object of this invention is to provide a safety valve actuated to close by flow and which releasably positions the operating tube in valve open position and the operating tube is released on predetermined upward movement by flow permitting snap closure of the valve.

BEST MODE FOR CARRYING OUT THE INVENTION

Figure 1A:
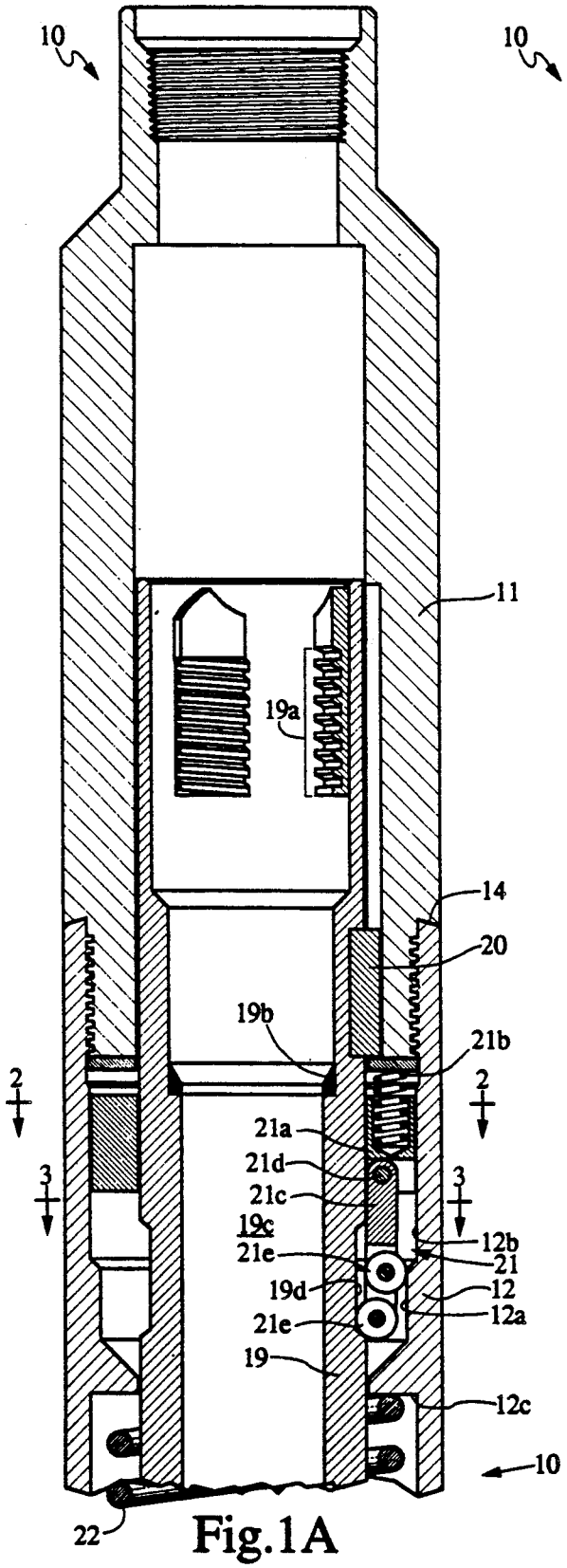
FIGS. 1A and 1B together are a sectioned drawing in elevation of the safety valve of this invention shown in valve open position.
Figure 1B:
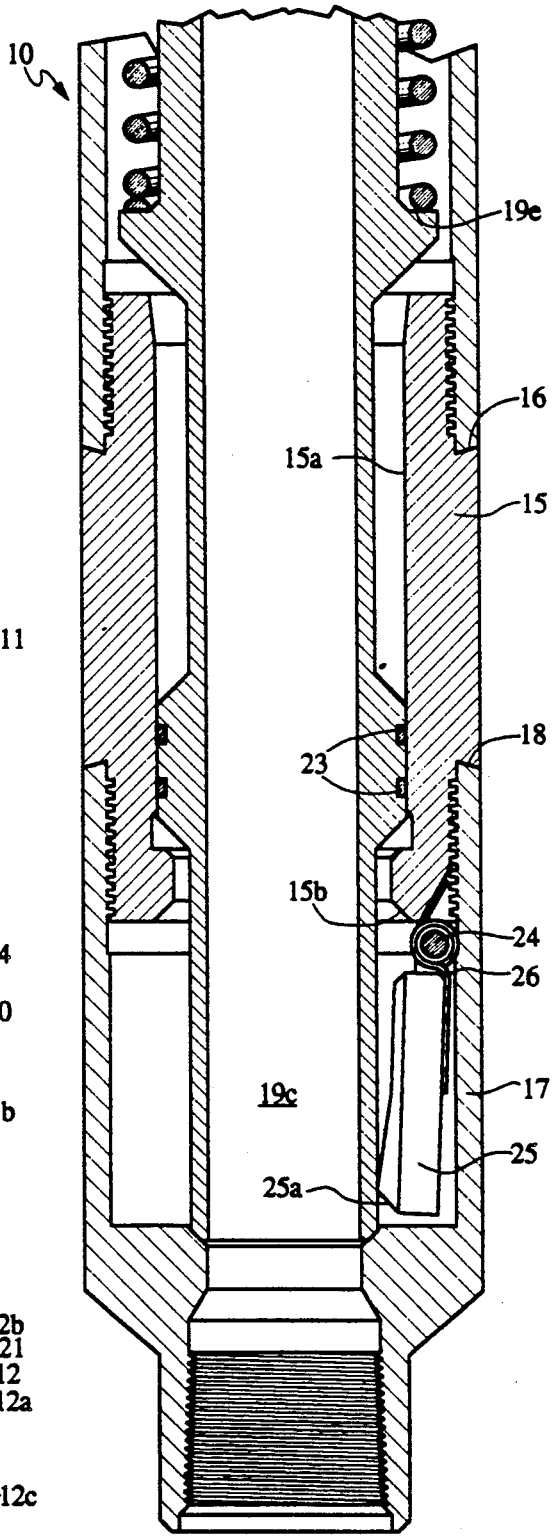

FIGS. 1A and 1B show the safety valve of this invention 10 having an upper housing 11, which is connectible in a well flow conduit and which is connected and sealed metal to metal with spring housing 12 at 14. Spring housing 12 is connected and sealed metal to metal to lower housing 15 at 16. Valve housing 17 is connected and sealed metal to metal to the lower housing at 18. A longitudinally moveable operating tube 19 is mounted in housings 11, 12, 15 and 17. A key 20 is mounted in the operating tube and slides ina key way in the upper housing to prevent rotation of the operating tube when a rotary lock mandrel is being installed or retrieved.

Figure 2:
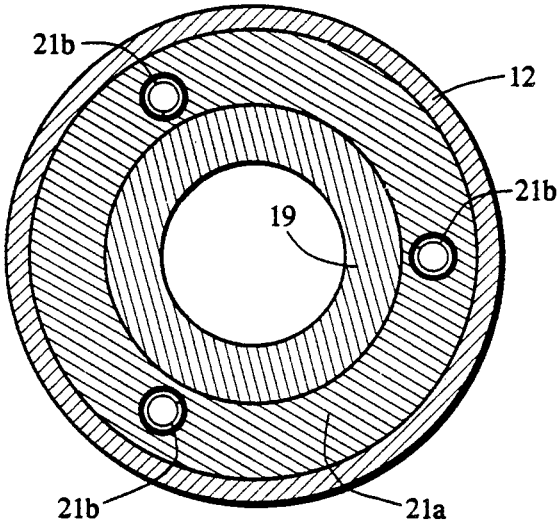
FIG. 2 is a cross sectional drawing along line 2—2 of FIG. 1.
Figure 3:
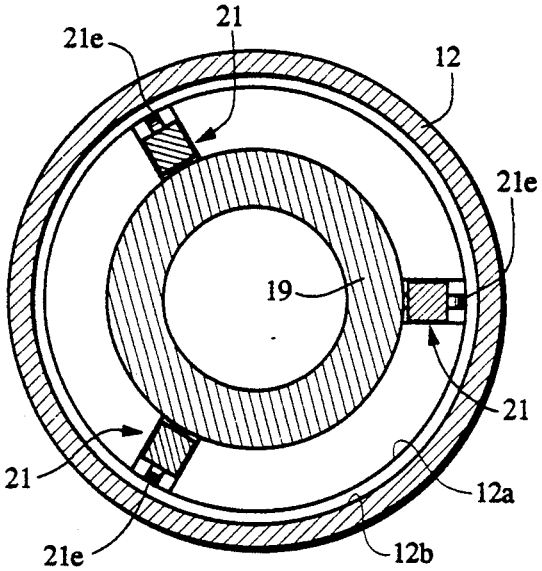
FIG. 3 is another cross sectional drawing along line 313 3 of FIG. 1.
Figure 4:
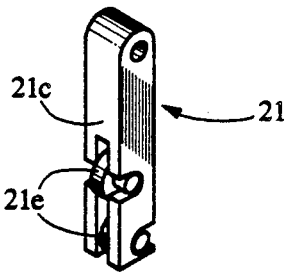
FIG. 4 is a perspective view of a releasable positioner arm with rollers.

The operating tube has locking recesses **19*a*, a metal seat 19*b* and a flow passage 19*c*. Mounted around the operating tube and cooperable with bore 12*a* and larger bore 12*b* in the spring housing and operating tube recess 19*d* is a snap closure mechanism or releasable positioner 21. This positioner includes a ring 21*a* having a number of holes in which are installed springs 21*b* (see FIG. 2), and a number of slotted arms 21c (see FIG. 3) pivotally connected in slots through the ring by pins 21d. A pair of rollers 21e are rotatively mounted on each arm as shown in FIG. 4**.

A spring 22 is mounted around the operating tube between shoulders 12c in the spring housing and 19e on the operating tube. Installed in grooves around the operating tube are metal ring seals 23 which slidably seal the operating tube in seal bore 15a in the lower housing.

Pivotally connected to lower housing 17 with pin 24 is a flapper valve 25. A torsion spring 26 biases the flapper valve toward closed position where metal seal surface 25a sealingly engages metal seat 15b on the lower housing. A flapper valve is shown in FIG. 1, although those skilled in valve art should readily realize any type metal valve could be used which is moveable between open and closed positions by a longitudinally moveable operating tube.

Figure 5A:
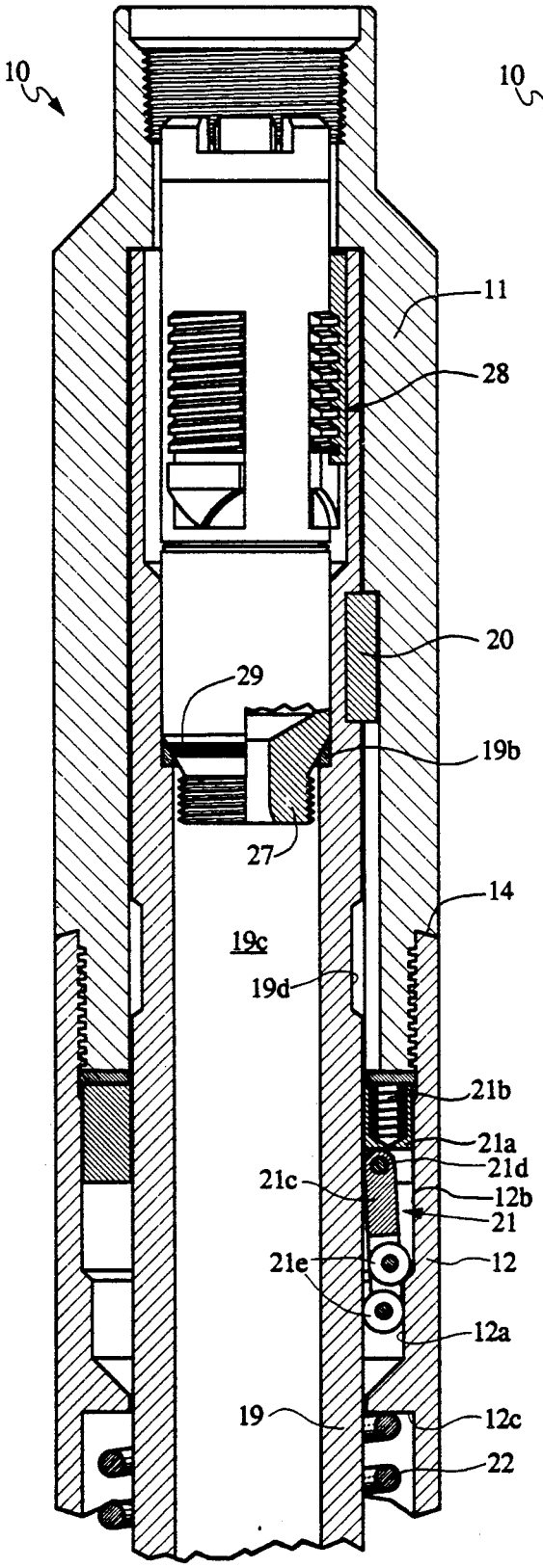
FIGS. 5A and 5B together are a sectioned drawing in elevation of the safety valve of this invention in closed position showing a rotary lock mandrel sealed and locked in the safety valve operating tube.
Figure 5B:
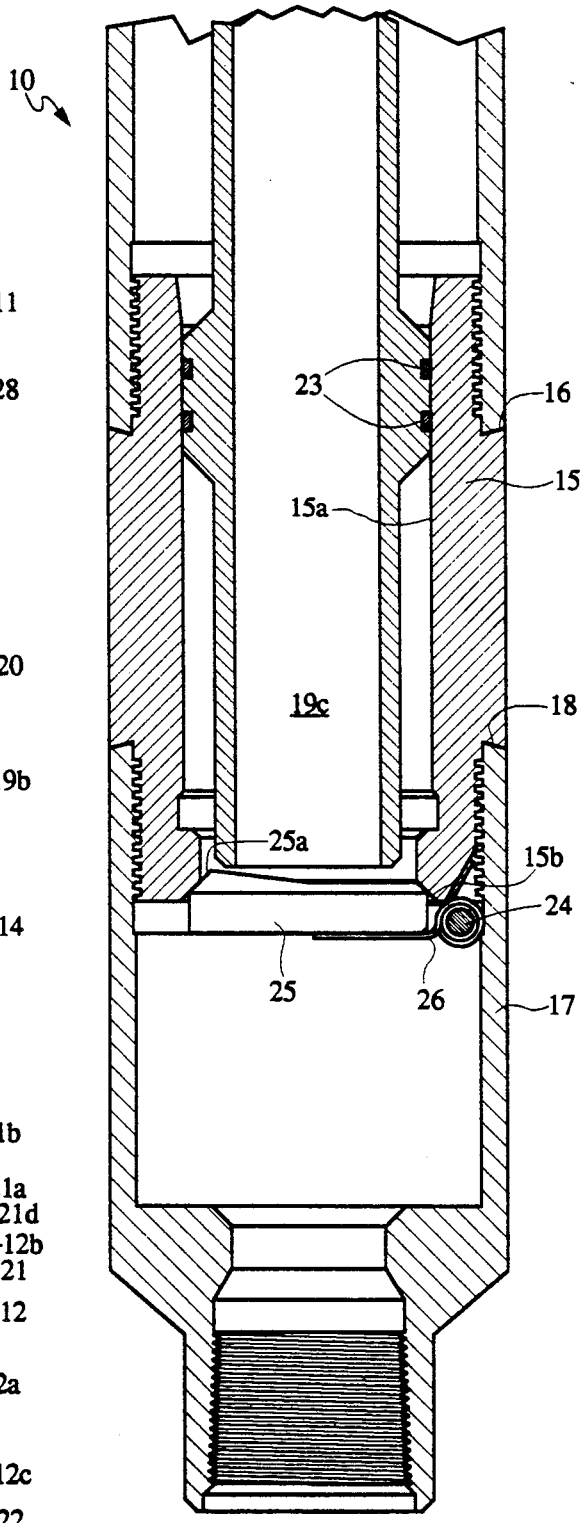

The safety valve 10 of this invention may be utilized to control flow from a well by connecting at the proper level in a well flow conduit and installing the conduit in a well. As shown in FIG. 5, a flow choke 27 of predetermined size is now connected on a lock mandrel 28, which has a metal seal surface 29. The lock mandrel is lowered in the flow conduit and is operated to lock in operating tube recesses 19d with metal seal surface 29 sealingly engaging operating tube metal seat 19b. Safety valve spring 22 positions the operating tube down in valve open position and releasable positioner upper rollers 21e engage spring housing bore 12a while lower rollers 21e are engaging operating tube recess 19d. Production flow upward through operating tube flow passage 19c will impinge on the lower end of flow choke 27, imparting an upward force on the sealed area between the inside diameter of the flow choke and the outside diameter of metal ring seals 23. When the upward flow force on the operating tube is sufficient to overcome the combined downward forces of valve spring 22 and positioner springs 21b, the operating tube is moved upwardly a very short distance and almost immediately, upper rollers 21e move outwardly to engage spring housing large bore 12b. Outward movement of the upper rollers permits outward movement of arms 21c and lower rollers from recess 19d, releasing the operating tube for quick upward movement and metal to metal valve closure preventing further upward flow through flow passage 19c, as shown in FIG. 5A and 5B. When higher pressure below the closed valve is reduced sufficiently, compressed spring 22 will automatically move the operating tube downwardly opening the valve. As operating tube downward movement continues and recess 19d moves inside lower rollers 21e, positioner springs 21b move ring 21a, arms 21c and upper rollers downwardly from bore 12b into bore 12a. The upper rollers on entering bore 12a move the arms inwardly and lower rollers into recess 19d, positioning the operating tube downwardly in valve open position. Flow may again occur in flow passage 19c and valve 10 will automatically snap closed when the closing production flow rate is reached.

The closing flow rate may be changed by unlocking the lock mandrel from the operating tube recesses and retrieving it to surface where a flow choke of the proper size is connected on the lock mandrel for resealing and locking in the operating tube.

What is claimed is:

1. A safety valve for a well actuated to close by production flow comprising:

(a) a housing connectible in a well flow conduit, said housing having a bore therethrough;

(b) valve means in said housing for controlling flow through said bore;

(c) an operating tube longitudinally moveable in said housing between a lower position opening said valve means and an upper position permitting said valve means to close, said operating tube sealed in said housing and having locking recesses and a seat therein;

(d) a spring between said housing and operating tube for moving said operating tube to said lower position opening said valve means;

(e) lock mandrel means releasably locked in said operating tube locking recesses, said lock mandrel means having a sealing surface sealingly engaged with said operating tube seat; and (f) releasable roller positioning means in said housing engageable with said operating tube for positioning said operating tube in said lower valve means open position, said roller positioning means releasable in response to a predetermined upward movement of said operating tube releasing said operating tube for quick movement to said upper position, said roller positioning means including:

a ring slidably mounted in the housing around the operating tube, a number of roller means connected to said ring, and biasing means for biasing said roller means to position said operating tube.

2. The safety valve of claim 1 wherein the seat in the operating tube is metal, said operating tube is sealed in the housing with metal seals and the sealing surface on the lock mandrel means is metal.

3. The safety valve of claim 1 wherein the valve means is a metal flapper type valve.

4. The safety valve of claim 2 wherein the lock mandrel means is releasably locked and sealingly engaged in the flow tube by rotation, said lock mandrel means including a flow choke.

5. The safety valve of claim 2 wherein the lock mandrel means is sealingly engaged and releasably locked in the flow tube by longitudinal movement, said lock mandrel means including a flow choke.

6. The safety valve of claim 1 wherein the releasable roller positioning means further comprise:

(a) a recess around the operating tube;

(b) a bore in the housing;

(c) a larger bore above said bore in the housing;

(d) the roller means engageable with said bore and said larger bore for inward movement into said operating tube groove positioning said operating tube and outward movement from said operating tube groove releasing said operating tube.

7. The safety valve of claim 6 wherein the roller means include an arm with a pair of rollers rotatively mounted thereon.

8. The safety valve of claim 7 wherein the means connecting the roller means to the ring include:

(a) slots in the ring, and (b) a pin through each arm into said ring positioning each arm in a slot.

9. The safety valve of claim 6 wherein the biasing means include holes in the ring, and a spring in each hole between the hole bottom and the housing.

10. A safety valve for a well actuated to close by production flow comprising:

(a) a housing connectible in a well flow conduit, said housing having a bore therethrough;

(b) a flapper valve in said housing for controlling flow through said bore;

(c) an operating tube longitudinally moveable in said housing between a lower position opening said valve means and an upper position permitting said valve means to close, said operating tube sealed in said housing with metal seals and having locking recesses and a metal seat therein;

(d) a spring between said housing and operating tube for moving said operating tube to said lower position opening said flapper valve;

(e) a rotary lock mandrel releasably lockable by rotation in said operating tube locking recesses, said rotary lock mandrel having a metal sealing surface sealingly engageable with said operating tube metal seat;

(f) releasable positioning means in said housing engageable with said operating tube for positioning said operating tube in lower flapper valve open position, said positioning means releasable in response to a predetermined upward movement of said operating tube releasing said operating tube for movement to said upper position, said positioning means including:

a ring slidably mounted in said housing, a recess around said operating tube, a bore in said housing, a larger bore above said bore in said housing, a number of roller means each having an arm with a pair of rollers rotatively mounted thereon, said roller means engageable with said bore and said larger bore for inward movement positioning said operating tube and outward movement releasing said operating tube, means connecting said roller means to said ring including slots in said ring, and a pin through each arm into said ring positioning each arm in a slot, and biasing means for biasing said roller means to position said operating tube including holes in said ring, and a spring in each hole between the hole bottom and said housing.

* * * * *